US011505433B2

(12) United States Patent
Aitamurto

(10) Patent No.: US 11,505,433 B2
(45) Date of Patent: Nov. 22, 2022

(54) ACCESS DOOR ARRANGEMENT OF AN ELEVATOR SHAFT

(71) Applicant: KONE Corporation, Helsinki (FI)

(72) Inventor: Juha-Matti Aitamurto, Helsinki (FI)

(73) Assignee: KONE CORPORATION, Helsinki (FI)

( * ) Notice: Subject to any disclaimer, the term of this patent is extended or adjusted under 35 U.S.C. 154(b) by 677 days.

(21) Appl. No.: 15/639,446

(22) Filed: Jun. 30, 2017

(65) Prior Publication Data

US 2017/0297868 A1 Oct. 19, 2017

Related U.S. Application Data

(63) Continuation of application No. PCT/EP2016/052982, filed on Feb. 12, 2016.

(30) Foreign Application Priority Data

Feb. 13, 2015 (EP) ..... 15155095

(51) Int. Cl.
*B66B 5/00* (2006.01)
*B66B 13/20* (2006.01)
(Continued)

(52) U.S. Cl.
CPC ..... *B66B 11/0005* (2013.01); *B66B 1/28* (2013.01); *B66B 13/00* (2013.01); *B66B 13/14* (2013.01);
(Continued)

(58) Field of Classification Search
USPC ..... 187/247
See application file for complete search history.

(56) References Cited

U.S. PATENT DOCUMENTS 7,650,971 B2 * 1/2010 Pillin ..... B66B 13/245 187/331
8,490,755 B2 * 7/2013 Lindberg ..... B66B 5/005 187/393
(Continued)

FOREIGN PATENT DOCUMENTS

CN 103276974 A 9/2013
CN 103964267 A 8/2014
EP 1 873 334 A2 1/2008

OTHER PUBLICATIONS

Chinese Office Action and Search Report for Chinese Application No. 201680010166.9, dated Jun. 19, 2019, with an English translation.
(Continued)

*Primary Examiner* — Christopher Uhlir
(74) *Attorney, Agent, or Firm* — Birch, Stewart, Kolasch & Birch, LLP

(57) ABSTRACT

An access door arrangement of an elevator shaft, wherein at least one elevator car is moving, includes a door lock, whereby in connection with the door lock a reset switch of an inspection mode resetting device is located, whereby the door lock has a lock part movable between a lock position and an open position and whereby the reset switch is integrated in said door lock to be operated by the movement of the movable lock part or a related movable part. This solution allows an easy resetting of the inspection mode of the elevator.

20 Claims, 3 Drawing Sheets

(51) Int. Cl.

| | |
|---|---|
| ***B66B 1/46*** | (2006.01) |
| ***B66B 11/00*** | (2006.01) |
| ***B66B 13/16*** | (2006.01) |
| ***B66B 1/28*** | (2006.01) |
| ***B66B 13/00*** | (2006.01) |
| ***B66B 13/14*** | (2006.01) |
| ***E05B 17/22*** | (2006.01) |
| ***E05B 35/00*** | (2006.01) |
| *E05B 47/00* | (2006.01) |

(52) U.S. Cl.
CPC ..... *B66B 13/16* (2013.01); *E05B 17/22* (2013.01); *E05B 35/008* (2013.01); *E05B 2047/0069* (2013.01)

(56) References Cited

U.S. PATENT DOCUMENTS

| | | | | |
|---|---|---|---|---|
| 8,602,171 | B2 * | 12/2013 | Vogl | B66B 5/0087 187/380 |
| 2008/0078628 | A1 * | 4/2008 | Christen | B66B 13/20 187/319 |
| 2011/0272216 | A1 * | 11/2011 | Kugiya | B66B 5/0031 187/301 |
| 2012/0291502 | A1 | 11/2012 | Frankham et al. | |

OTHER PUBLICATIONS

International Search Report (PCT/ISA/210) issued in PCT/EP2016/052982, dated Mar. 29, 2016.
Written Opinion of the International Searching Authority (PCT/ISA/237) issued in PCT/EP2016/052982, dated Mar. 29, 2016.

* cited by examiner

ACCESS DOOR ARRANGEMENT OF AN ELEVATOR SHAFT

CROSS REFERENCE TO RELATED APPLICATIONS

This application is a Continuation of PCT International Application No. PCT/EP2016/052982, filed on Feb. 12, 2016, which claims priority under 35 U.S.C. 119(a) to patent application Ser. No. 15/155,095.1, filed in Europe on Feb. 13, 2015, all of which are hereby expressly incorporated by reference into the present application.

BACKGROUND OF THE INVENTION

The present invention relates to an access door arrangement of an elevator shaft in which elevator shaft at least one elevator car is moving. Each access door to the elevator shaft comprises a particularly manual door lock. In case of a normal landing door the locking of the landing door is coupled to the elevator operation, whereby opening and locking of the landing door is correlated to the stop of the elevator car at the respective floor. Hereby the landing door is coupled to the car door and driven by a door drive of the elevator car. Anyway, usually each landing door has an emergency unlocking device, i.e. a manually openable door lock, which is usually operated by a service technician, particularly via a triangle key, e.g. to set trapped passengers free. Another kind of access door is an inspection hatch which has normally a simple door lock which only can be operated by a service technician, preferably via a triangle key.

Generally, service technicians are able to drive an elevator car manually from inside the elevator shaft with inspection drive buttons while standing on a top platform or in the pit. On this behalf he has to operate an inspection switch into inspection position. This turns the elevator into inspection mode. After finishing his work, the service technician turns the inspection switch back to its normal position and then leaves the elevator shaft, whereafter the elevator has to be reset from the inspection mode into normal operation mode. This is usually done via a reset device inside a locked cabinet as e.g. described in EN81-1: 1998 A2: 2004 in clause 6.4.4.1H.

SUMMARY OF THE INVENTION

It is object of the present invention to provide an access door arrangement which allows an easy and safe reset of the elevator from inspection mode into normal operation mode.

The object is solved with an arrangement according to claim 1. Preferred embodiments of the invention are subject-matter of the dependent claims. Some inventive embodiments are also presented in the descriptive section and in the drawings of the present application. The inventive content may also consist of several separate inventions, especially if the invention is considered in the light of expressions or implicit subtasks or from the point of view of advantages achieved. In this case, some of the attributes contained in the claims below may be superfluous from the point of view of separate inventive concepts. The features of the various embodiments of the present application can be applied within the framework of the basic inventive concept in conjunction with other embodiments.

According to the invention, the inventive access door arrangement comprises an access door with a door lock, which e.g. is either an emergency unlocking device of a landing door or the door lock of a special shaft access door, e.g. inspection hatch. In connection with the door lock of the access door, a reset switch of an inspection mode resetting device is located, which resets the elevator into normal operation mode after the reset switch is operated. The door lock has a movable lock part, for example a lock latch or a lock bolt, movable between a lock position and an open position and the reset switch is integrated in said door lock to be operated by the movement of the movable lock part or a part connected thereto between the open and lock position. The advantage of the present invention is that with the closing of the pit access door and with the moving of the movable lock part into the lock position, the reset switch of the inspection mode resetting device is operated, so that the elevator is switched from elevator inspection mode in normal operation mode as to be available for public use again.

An essential advantage of the invention is that this resetting of the inspection mode is done via the simple movement of the movable part of the door lock form the open to the lock position so that no additional steps are necessary to reinstate the elevator into normal operation mode.

Another advantage of the invention is that, because the resetting means are included in the pit access door lock, there is no need to locate the locked cabined next to the pit access door but its location can be selected freely.

Still one essential advantage of the invention is that it is possible to use implement the reset function with same emergency unlocking devices as used earlier, which devices can be turned from initial position only to one (clock-wise) direction.

In a preferred embodiment of the invention, the door lock of the emergency unlocking device includes a triangle key connected to the movable lock part. The advantage of a triangle key is that it is available by service technicians but not by normal passengers. Thus, the obligatory use of a triangle key for the emergency unlocking device of a landing door or for the door lock of an inspection door/hatch ensures that the resetting of the inspection mode into normal operation mode can only performed by service technicians.

In a preferred embodiment of the invention, the movable lock part counter-acts with a sliding surface located in connection with a fixed structure surrounding the access door or being adjacent to the access door or with another access door (e.g. in case of a centrally opening landing door), which sliding surface extends at least partly along the way of the movable lock part between its open position and lock position, whereby the reset switch is located in connection with the sliding surface. Via this means it is ensured that the reset switch is only triggered when the movable lock latch of the access door counter-acts with the sliding surface which automatically means that the access door is closed, because counter-action of the movable lock part with the sliding surface is only possible when the access door is closed.

In this case, preferably the sliding surface is covered by a cover element to prevent the operation of the reset switch by accidental manual contact.

Of course, it is not necessary that the reset switch is operated by the movable lock part itself but it can also be operated by any operating part which is connected with the movable lock part and therefore moves along with the lock part or triggered by it. This can even be a part of the key of the door lock. Such an embodiment is easy to accomplish and works reliably. Furthermore, the operating part connected to the lock part can be made to optimally counteract with the switch element of the reset switch.

In a preferred embodiment, the reset switch comprises a pivoted lever which is actuated by an operating part connected to the movable lock part on its way between the open and lock position.

In one embodiment of the invention, the reset switch is fixed to the access door and is operated by the lock part or an operating part connected thereto. Via this advantageous solution, the reset switch of the inspection mode resetting device as well as the movable lock part are both located in connection with the access door which, is easy to manufacture.

In a preferred embodiment of the invention, in connection with the reset switch a second switch is located which issues a signal for a safety space arrangement for a reduced shaft pit or shaft top. This second switch is able to issue a signal which has an effect to safety measures in the elevator shaft to ensure the provision of a safety space when the height of the shaft top or shaft pit is smaller than required by international regulations. This advantageous embodiment therefore enables the simultaneous change of the modes of different devices in the elevator shaft which are provided for the safety of the service technicians working in the shaft.

Preferably, the movement of the movable lock part into its lock position is prevented by a blocking mechanism when the access door is not closed. Via this measure it is avoided that the door lock can be switched into the lock position when the access door is still not closed. Therefore, the blocking mechanism only allows the interaction with the reset switch when the access door is closed, which ensures that the elevator shaft is closed together with the reset of the elevator into normal operation mode.

The movable lock part may be any part which enables the door lock to lock or to open the door lock of the access door. Thus, the lock part may be a pivoted lock latch or an axially or translatory movable lock bolt.

The access door may be any landing door of the elevator shaft and/or the top and/or bottom access hatch of the elevator shaft.

Preferably the door lock comprises a door contact, and the elevator control is configured to consider the signal of the reset switch dependent on the status of the door contact. Via this measure it is ensured that the elevator control can reset the inspection mode only when the access door is closed. The door contact can e.g. be connected parallel to the reset switch.

Preferably the arrangement comprises an elevator control which is configured to decode a moving sequence of the movable lock part into a reset signal for the inspection mode of the elevator. Via this measure only two positions of the door lock have to be provided, preferably open and closed, whereby the triggering of the reset can be performed via a defined moving sequence which is recognized by the elevator control or a logic connected thereto. The moving sequence can be chosen freely, and can thus defined as desired. One preferable moving sequence is closed/open/closed status. This sequence is easy to perform. The sequence has to be performed within a given time frame to be recognized as such or the moving sequence has to be different from the moving sequences during normal use of the door lock.

Of course, the invention also relates to an elevator comprising an arrangement of the aforementioned type.

The invention further relates to a method for resetting elevator control from inspection mode to normal mode, which method comprising following sequence of steps:

during inspection mode the inspection switch in the pit inspection station is turned from an inspection position to normal operation position, exiting the pit and closing a pit access door having a door lock connected with a reset switch for the inspection mode of the elevator, after closing the access door, operating manually the door lock according to a given moving sequence to cause the reset switch to change its status according to the moving sequence of the door lock, reading the switching state of the reset switch, turning the elevator from inspection mode to normal operation mode when the status of the reset switch changes according to the moving sequence.

The moving sequence is preferably the movement of the door lock from lock position to open position within a given time period causing the reset switch to change from a first status to a second status. This moving sequence is easy to perform by any service technician.

The moving sequence is preferably the movement of the door lock from lock position to open position and back to lock position within a given time period causing the reset switch to change from a first status to a second status and further back to the first status. This moving sequence is quite unique as it differs from normal use of the door lock and it is easy to perform by any service technician.

This inventive solution has the advantage that the door lock does not need a second turning range for the resetting of the inspection mode. The fact that the moving sequence of the movable lock part of the door lock is monitored and recognized by the elevator control or by a logic connected thereto as a trigger signal opens the possibility to use a normal door lock with only two positions (locked and open). No additional position of the door lock is necessary to perform the reset from elevator inspection mode into normal operation mode. This enables the issuing of a proper reset signal with simple hardware equipment.

Of course, the sequence has to be performed within a given time frame to be recognized as such, and on the other hand a logic in the elevator control or elsewhere is necessary to decode this sequence into a trigger signal for the inspection mode reset. This method provides easy and reliable reset of the inspection mode into normal operating mode.

The reading of the reset switch status is preferably performed via the elevator control.

Preferably, the pit access door has a door contact which is also observed on its open or closed status. The reset into normal operation mode is preferably possible only when at the end of the moving sequence the door contact is in closed status. This ensures the access door being closed when the reset is performed.

The first status of the reset switch is preferably related to a lock status and its second status is correlated to an open status of the door lock.

Preferably, in this method the elevator is reset from inspection mode to normal operation mode when observing that the status of the reset switch changes from a first to a second status and further back to the first status, and additionally the door contact changes from closed status to open status and back to closed status. With this measure the locked status of the access door is considered fur the reset of the inspection mode of the elevator, which meets required safety standards.

Before the reset of the inspection mode any mechanical stopping devices in the elevator shaft have to be moved into their idle position for normal operation mode. The stopping devices may be moved manually or automatically. In this connection the elevator control may consider the monitored sequence of the door lock movements coded as a reset signal only after the stopping devices have assumed their idle position.

The moving sequence may be considered by the elevator control also as a trigger signal for automatically moving the stopping devices from their active position—in which they ensure a safety room in the pit—into their idle or inactive position, e.g. via electric or hydraulic drives. On that behalf the position of the mechanical stopping devices is available for the elevator control via position contacts located in connection with the stopping devices.

Generally, an arrangement for resetting the inspection mode of the elevator comprises aside of the above mentioned door arrangement all necessary components as e.g. at least one of the following components, i.e. switches, contacts, wiring for providing status information about the switches and contacts to the elevator control, which is configured to perform the switching from inspection mode to normal operation mode. These components are, door contacts, reset switches, status switches of stopping devices, drives of stopping devices, the elevator control or related logic components, wiring and the related software, e.g. for the definition of the moving sequence.

BRIEF DESCRIPTION OF THE DRAWINGS

The invention is hereinafter described by the aid of the schematic drawings in connection with embodiments of the invention.

DESCRIPTION OF THE PREFERRED EMBODIMENTS

Figure 1:
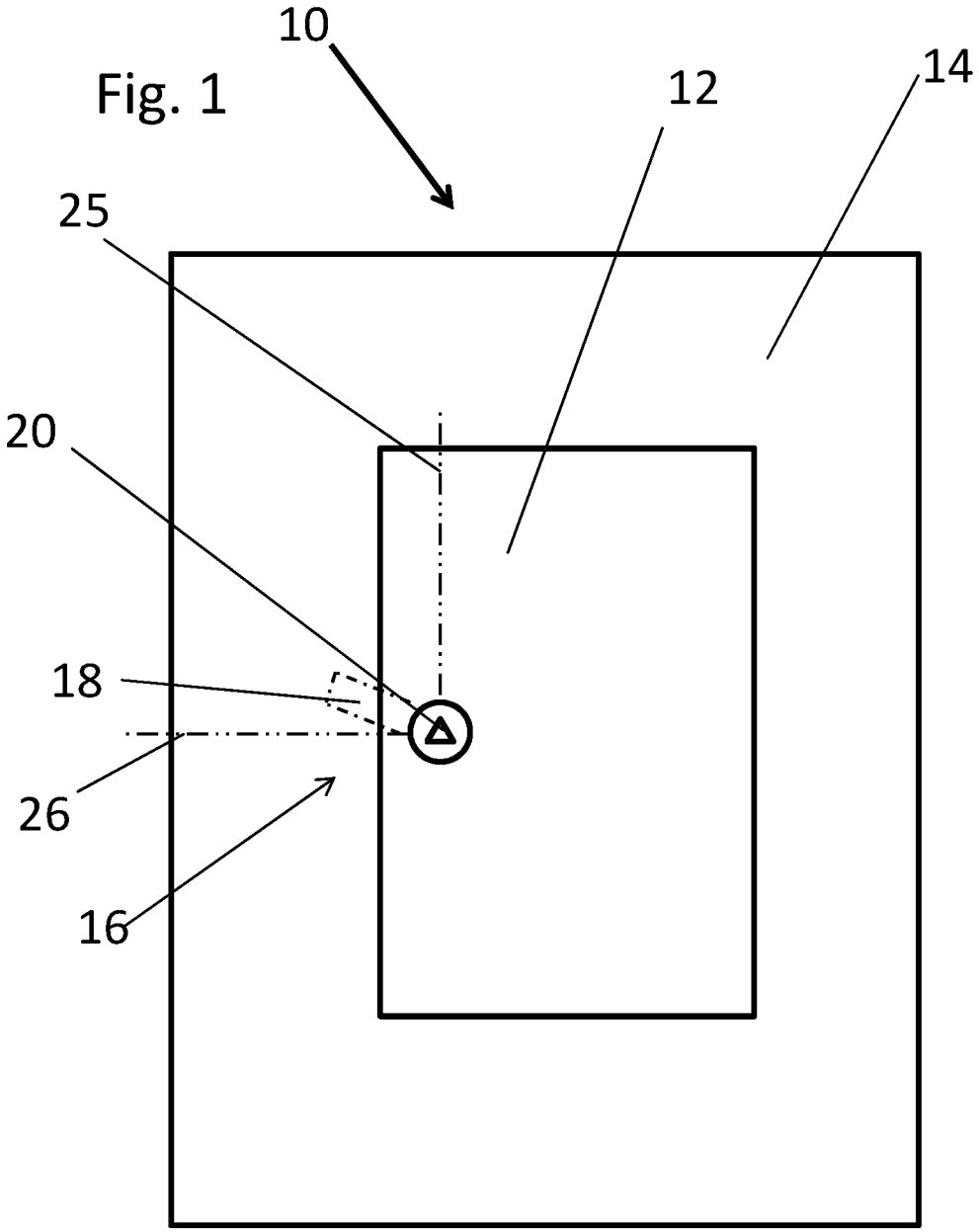
FIG. 1 shows a view on an inspection hatch of an elevator.
Figure 2:
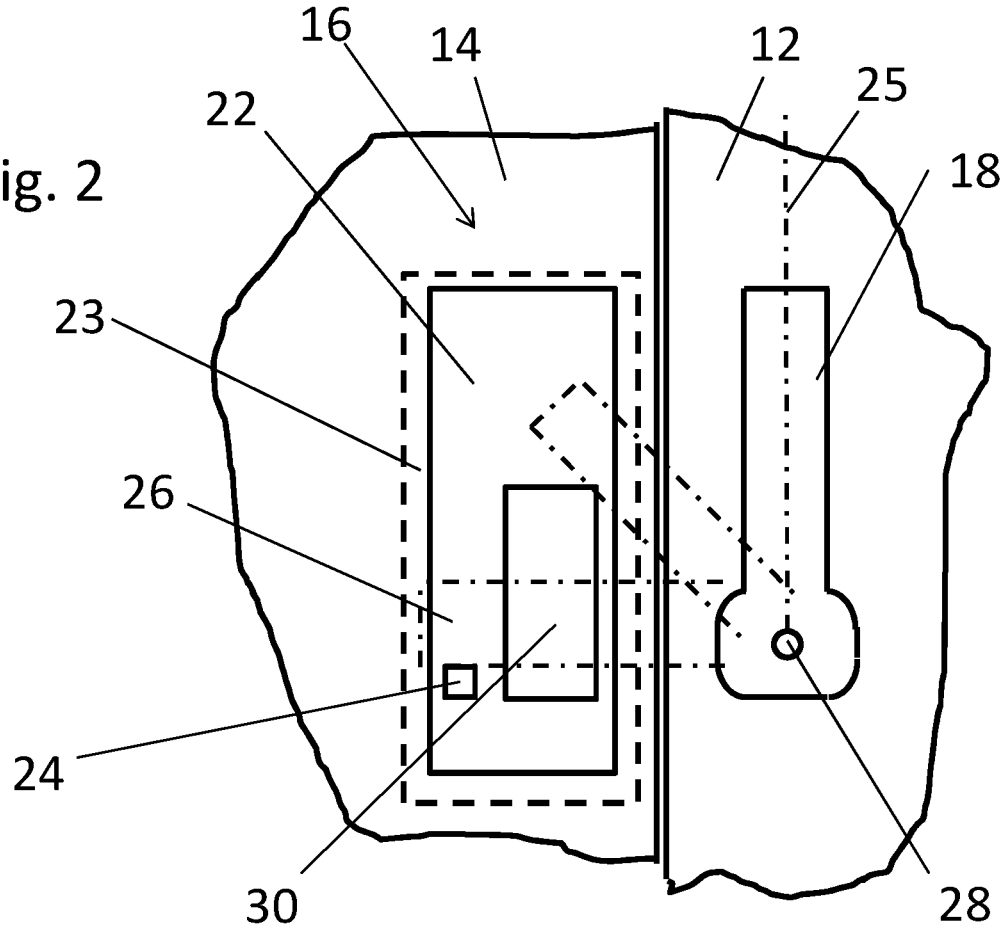
FIG. 2 shows a detail of the door lock of the access hatch from FIG. 4.

FIG. 1 shows an inspection hatch arrangement 10 wherein the access door to the elevator shaft is an inspection hatch 12, pivoted at an elevator shaft wall structure 14. The inspection hatch 12 has a door lock 16 which comprises a turnable lock latch 18 connected with a triangle key part 20 on the inspection hatch side and on the elevator shaft wall side a sliding surface 22 with a stopper 24 which defines the lock position 26 of the lock latch which is shown in FIG. 2 with dotted lines. The open position 25 of the lock latch is marked with a vertical dotted line.

FIG. 2 shows in continuous lines the open position of the lock latch 18 wherein it extends vertically from its pivot axis 28. In the sliding surface 22, a pivoted switch element 30 of a reset switch extends from the sliding surface 22 as a ramp. When the lock latch 18 turns from its open position 25 into its lock position 26, it pushes the switch element 30 down which triggers the reset switch of the inspection mode resetting device which turns the elevator back to normal operation mode.

Figure 3:
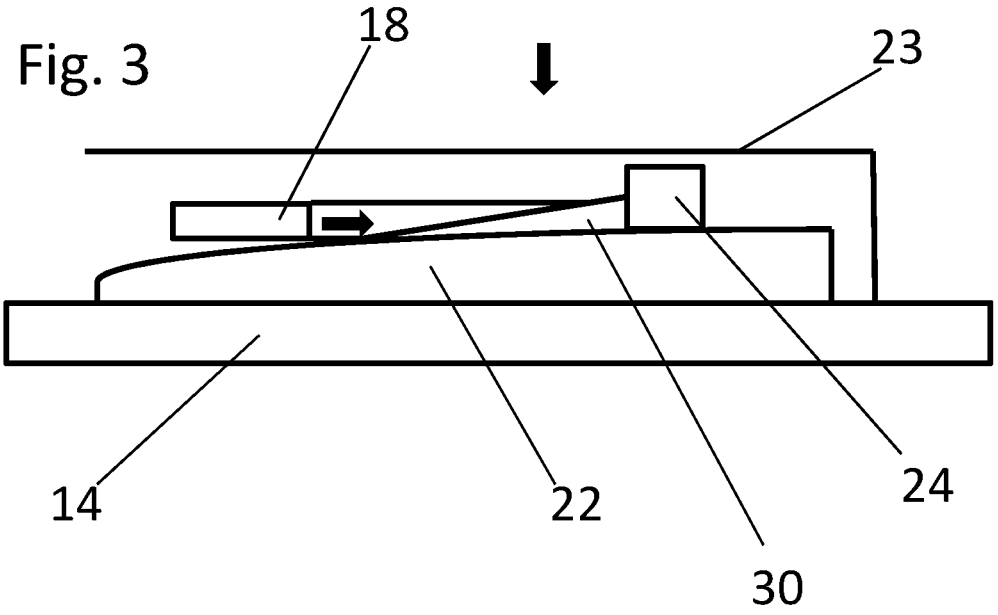
FIG. 3 shows a side view III of FIG. 2.
Figure 4:
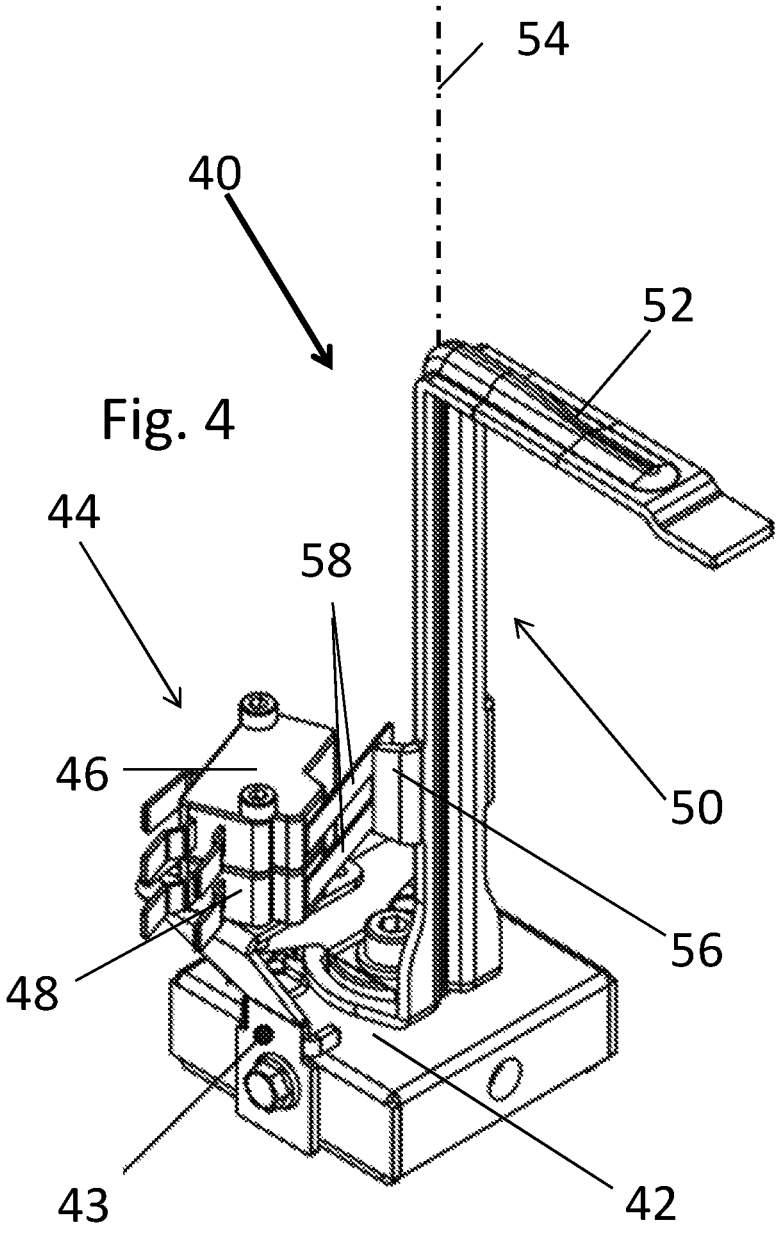
FIG. 4 shows a door lock with a lock latch being provided with a double switch.

FIG. 4 shows a second embodiment 40 of a door lock arrangement which is in this case an emergency unlocking device of a landing door, having a basis part 42 mounted to the access door or access hatch of the elevator shaft which basis part 42 carries via a support element 43 a double switch 44 with a reset switch 46 being part of the inspection mode resetting device and a second switch 48 being part of a safety space device regarding the operation of components in the elevator shaft to ensure a safety space when the dimensions of the shaft top or shaft pit are not sufficient to meet the international regulations. The emergency unlocking device 40 has a pivoted lock latch 50 which comprises a lock portion 52 extending perpendicular to the pivot axis 54 of the lock latch 50. This lock portion 52 grips behind a sliding surface as it is e.g. shown in FIGS. 2 and 3. Connected to the movable lock latch 50 is an operating part 56 co-acting with pivoted operating levers 58 of both switches 46, 48. Via this means, both switches 46, 48 are operated when the lock latch 50 is moved via the triangle key (FIG. 1) from its open position into its lock position.

The invention is not limited to the described embodiments but may be varied within the scope of the appended patent claims.

LIST OF REFERENCE NUMBERS

10 inspection hatch arrangement
12 inspection hatch
14 elevator shaft wall structure
16 door lock
18 lock latch
20 triangle key part
22 sliding surface
24 stopper
25 open position
26 lock position
28 pivot axis
30 pivoted switch element
40 door lock arrangement
42 basis part
43 support element
44 double switch
46 reset switch
48 second switch
50 lock latch
52 lock portion
54 pivot axis
56 operating part
58 operating levers of the switches

The invention claimed is:

1. A pit access door arrangement of an elevator shaft of an elevator, in which at least one elevator car is moving, the pit access door arrangement comprising:

a manually operated door lock provided on a pit access door;

an inspection mode resetting device including a reset switch, said reset switch being operable to turn an elevator from an inspection mode to a normal operation mode, wherein the door lock has a lock part movable between a lock position in which the lock part locks the pit access door and an open position in which the lock part unlocks the pit access door such that the pit access door can be opened, in response to a manual operation of the manually operated door lock, and the reset switch is integrated in said door lock in such a manner that the reset switch is operated to turn the elevator from the inspection mode to the normal mode directly by the movement of the movable lock part or a part fixed on the movable lock part when the manually operated door lock is manually operated to mechanically cause the movable lock part to move from the open position to the lock position, wherein the pit access door arrangement is configured in such a manner that manually operating the door lock directly causes the movable lock part to move from the open position to the lock position to directly activate the reset switch, such that the reset switch is activated to turn the elevator from the inspection mode to the normal mode by only manually operating the door lock without further operations, and wherein the arrangement comprises an elevator control which is configured to decode a sequence of lock/opening moves of the lock part into a reset signal for the inspection mode of the elevator.

2. The arrangement according to claim 1, wherein the door lock includes a triangle key connected to the lock part.

3. The arrangement according to claim 1, wherein the lock part counter-acts with a sliding surface located in connection with a structure surrounding the access door, which sliding surface extends at least partly along the way of the lock part between its lock position and open position, whereby the switch is located in connection with the sliding surface.

4. The arrangement according to claim 3, wherein the sliding surface is covered by a cover element.

5. The arrangement according to claim 1, wherein the switch is fixed to the pit access door and is operated by an operating part connected to the lock part.

6. The arrangement according to claim 5, wherein switch comprises a pivoted lever which is actuated by the operating part of the lock part on its way between the open and lock position.

7. The arrangement according to claim 1, wherein in connection with the switch a second switch is located which issues a signal for a safety space arrangement for a reduced shaft pit/shaft top.

8. The arrangement according to claim 1, wherein the movement of the lock part into its lock position is prevented by a blocking mechanism in response to the pit access door being not closed.

9. The arrangement according to claim 1, wherein the door lock comprises a door contact, and an elevator control is configured to consider a signal of the reset switch dependent on a status of the door contact.

10. The arrangement according to claim 1, wherein the pit access door is a landing door of the elevator or an inspection hatch in the bottom of the elevator shaft.

11. An elevator comprising the arrangement according toclaim 1.

12. A method of using the pit access door arrangement according to claim 1 for resetting elevator control from inspection mode to normal operation mode, said method comprising the steps of:

during inspection mode, turning an inspection switch in a pit inspection station from an inspection position to normal operation position;

exiting a pit and closing a pit access door having a door lock connected with a reset switch for the inspection mode of the elevator;

after closing the access door, operating manually the door lock in a given moving sequence to cause the reset switch to change its status according to the moving sequence of the door lock;

reading the status of the reset switch; and turning the elevator from inspection mode to normal operation mode when the status of the reset switch changes according to the moving sequence.

13. The method according to claim 12, wherein the moving sequence is the movement of the door lock from lock position to open position within a given time period, causing the reset switch to change from a first status to a second status.

14. The method according to claim 13, wherein the moving sequence is the movement of the door lock from lock position to open position and back to lock position within a given time period, causing the reset switch to change from a first status to a second status and further back to the first status.

15. The method according to claim 12, wherein a door contact of the access door is observed on its open or lock position and the reset of the elevator into normal operation mode is allowed only when at the end of the moving sequence the door contact is in closed status.

16. The method according to claim 13, wherein the elevator is reset from inspection mode to normal operation mode when additionally a door contact changes, preferably together with the reset switch from a closed status to open status and back to closed status.

17. The method according to claim 12, wherein the reset of the inspection mode is only possible after any mechanical stopping device in the elevator shaft has been moved into its idle position for normal operation mode.

18. The arrangement according to claim 2, wherein the lock part counter-acts with a sliding surface located in connection with a structure surrounding the access door, which sliding surface extends at least partly along the way of the lock part between its lock position and open position, whereby the switch is located in connection with the sliding surface.

19. The arrangement according to claim 2, wherein the door lock comprises a door contact, and an elevator control is configured to consider a signal of the reset switch dependent on a status of the door contact, and the movement of the lock part into its lock position is prevented by a blocking mechanism in response to the pit access door being not closed, such that an inspection mode resetting is prevented when the pit access door is not closed.

20. The arrangement according to claim 1, wherein the reset switch includes a first switch being part of the inspection mode resetting device, and a second switch being part of a safety space device regarding operation of components in the elevator shaft, the lock part extends perpendicularly from a pivot axis thereof, and pivots, by manually operating the door lock, to engage with a sliding surface, and the part fixed on the movable lock part co-acts pivoted operating levers of both first and second switches, such that both switches are activated when the lock part is moved by manually operating the door lock from the open position to the lock position.

* * * * *